US005344289A

United States Patent [19]

Fasce

[11] Patent Number: 5,344,289

[45] Date of Patent: Sep. 6, 1994

[54] DEFLECTION SYSTEM FOR ALIEN PARTICLES IN A REFRIGERATION MOTOR COMPRESSOR

[75] Inventor: Antonio Fasce, S. Genesio, Italy

[73] Assignee: Necchi Compressori S.r.l., Pavia, Italy

[21] Appl. No.: 73,448

[22] Filed: Jun. 8, 1993

[30] Foreign Application Priority Data

Jul. 3, 1992 [IT] Italy ..... PV92 A 000007

[51] Int. Cl.[5] ..... F04B 21/00

[52] U.S. Cl. ..... 417/312; 181/403

[58] Field of Search ..... 417/312, 902; 181/403

[56] References Cited

U.S. PATENT DOCUMENTS

| | | | |
|---|---|---|---|
| Re. 33,902 | 4/1992 | Fritchman | 181/403 |
| 1,381,056 | 6/1921 | Blakely | 181/403 |
| 2,133,875 | 10/1938 | Steenstrup | 417/31 |
| 3,044,688 | 7/1962 | Frank et al. | 417/312 |
| 3,075,686 | 1/1963 | Steinhagen | 417/363 |
| 4,313,715 | 2/1982 | Richardson | 417/312 |
| 4,401,418 | 8/1983 | Fritchman | 417/312 |
| 4,696,629 | 9/1987 | Shiibayashi et al. | 417/902 |
| 5,055,010 | 10/1991 | Logan | 417/312 |

*Primary Examiner*—Richard A. Bertsch
*Assistant Examiner*—Peter Korytnyk
*Attorney, Agent, or Firm*—Stevens, Davis, Miller & Mosher

[57] ABSTRACT

A muffler system for a refrigeration motor-compressor comprising an upper and lower case, a compressor formed by a motor and by a body in which a muffler is fixed, a tube fixed to the lower case conveying the refrigerant gas into the cases, an asymmetric side groove provided along the muffler and positioned with regard to the tube, through which the gas arrives in the case, in such a way that the refrigerant gas passes near a farther side of the groove with an angle of incidence causing the alien particles suspended in the gas to rebound far from the muffler and the gas to be kept by the groove side nearer to the tube and an inlet in the groove for conveying the gas to the compressor cylinder.

3 Claims, 2 Drawing Sheets

FIG. 3
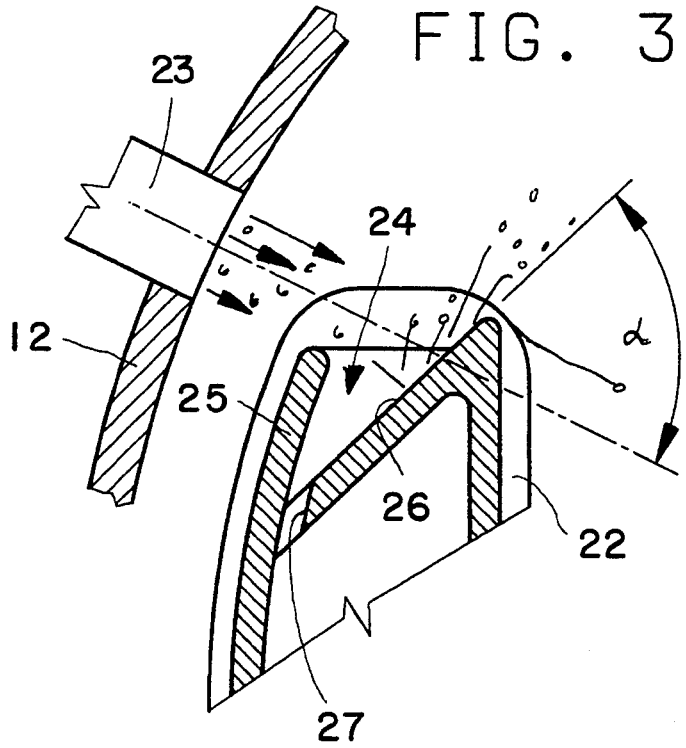
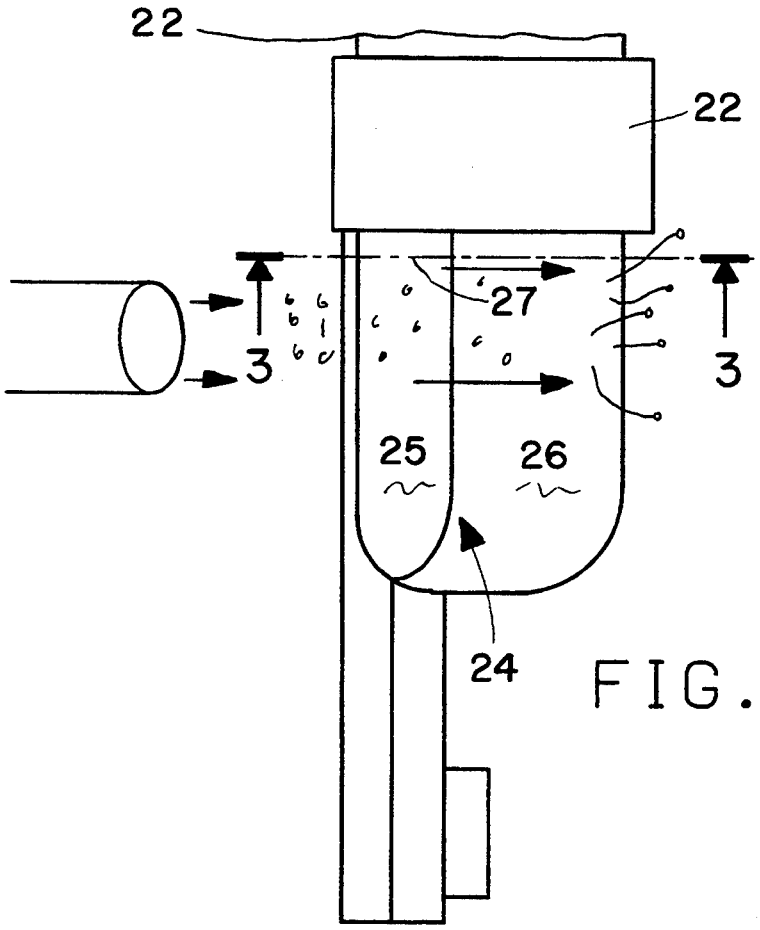
FIG. 2

DEFLECTION SYSTEM FOR ALIEN PARTICLES IN A REFRIGERATION MOTOR COMPRESSOR

BACKGROUND OF THE INVENTION

1. Field of the Invention

The present invention relates to a muffler system for refrigeration motor-compressors and more precisely to suction muffler.

2. Description of the Prior Art

As it is well known, when the compressor is assembled, it is installed in the refrigerator and hermetically connected to the refrigeration circuit. Such a hermetic connection does not allow any maintenance within the refrigeration circuit components, thus it is important that no working or soldering residues remain within the system, risking damage to the most important components, such as for example the valve plate-piston unit where the refrigerant gas is sucked and then pumped at determined pressure into the refrigeration circuit. The compressor components, before being assembled, are accurately washed in order to remove any alien particles therefrom. This operation may not be effected in the portion of the circuit placed in the refrigerator, which is composed of a condenser and an evaporator, because it is too difficult and expensive. Compressors are known where a filter is inserted in the suction muffler in order to avoid the alien particles from reaching the valve plate-piston unit.

In such a way, the particles are stopped by the filter which may partially or completely clog and since it is impossible to replace the filter, a smaller quantity of gas is sucked into the compression chamber. This is due to the fact that the gas warms before entering the compressor chamber and thus its volume increases. As a consequence, there is a smaller discharge of compressed gas in the circuit and thus a lower efficiency of the refrigerator.

In other compressors, on the muffler, near the entry hole, a little plate is positioned perpendicularly to the refrigerant gas entry direction. Any particles suspended in the gas, strike against the little plate and, precipitate in the compressor bottom while the gas passes into the muffler through the hole near said little plate. By this solution the particles which strike the little plate, rebound, and enter the muffler hole and thus reach the valve plate-piston unit, to damage it. Another drawback of this solution is due to the fact that the little plate, as it is continuously struck by the gas which enters the compressor at a pressure of about 5 atmospheres,may break and so is no longer directed toward the muffler hole.

A further drawback of this solution is the considerable vibration to which the little plate is subjected and thus an increase of noise.

SUMMARY OF THE INVENTION

It is the purpose of the present invention to overcome the above described drawbacks.

The technical problem to be solved is the realization of a simple suction muffler which allows the separation of the alien particles from the refrigerant gas and avoids vibrations and stress to the components and consequent damage or increase in noise. A muffler system for refrigeration motor-compressors on which a V-shaped groove formed with asymmetric sides, is positioned transverse to the longitudinal axis of the suction tube. The side which is nearer to the suction tube being of less depth than the side which is further away from the suction tube. The angle of incidence of the refrigerant gas against the side which is further away from the suction tube is less than 90° so as to cause alien particles suspended in the gas to rebound away from the muffler while the gas is sucked, through the inlet formed in an end of the apex of the groove, in the compressor cylinder.

The solution of the technical problem is characterized by the fact that an asymmetric side groove is provided along the muffler and is positioned with regard to the tube, through which the gas arrives in the case, in such a way that the refrigerant gas passes near the farther side of said groove with an angle of incidence causing the alien particles suspended in the gas to rebound away from said muffler and the gas to be kept by the groove side nearer to said tube, means being provided in said groove for conveying the gas to the compressor cylinder.

BRIEF DESCRIPTION OF THE DRAWINGS

Further characteristics and advantages will become more clearly apparent by the following description and the enclosed drawings in which:

FIG. 2 is a side view of the muffler of FIG. 1

FIG. 3 is a section taken on line 3–3 of FIG. 2

DESCRIPTION OF THE PREFERRED EMBODIMENT

Figure 1:
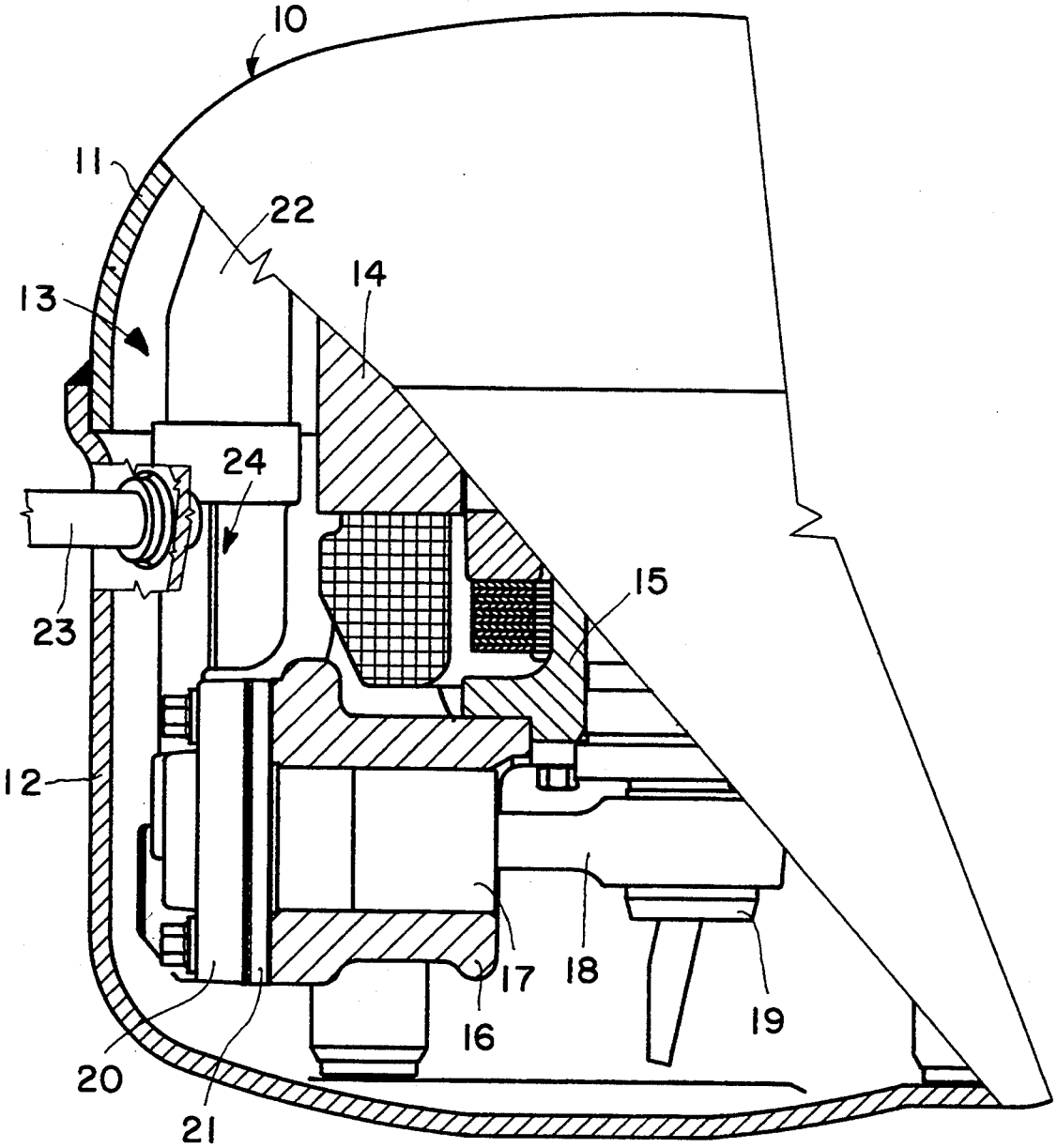
FIG. 1 illustrates a compressor provided with the muffler object of the present invention

With reference to FIG. 1 it has been generically indicated with 10 a hermetic motor-compressor comprising an upper case 11 and a lower case 12 which include the compressor 13 formed by an electric motor 14 placed over a body 15 in which the cylinder 16 is positioned. In said cylinder 16 the piston 17 is set in motion by a connecting rod 18 connected to a vertical shaft 19 which is put in motion by the motor 14.

The cylinder 16 is frontally closed by a head 20 which includes the valve plate 21. On said head 20 a suction muffler 22 is fixed near a tube 23, fixed to the lower case 12, which conveys the refrigerant gas coming from the evaporator, (not illustrated in the drawings) placed inside the refrigerator, to the motor-compressor 10.

On the muffler 22 (FIGS. 1–3) a V-shaped groove 24 is made out with two asymmetrical sides 25 and 26; the side 25, with regard to the vertex of the groove 24, of less depth than the side 26.

The gas coming from the tube 23 passes near the side 26 with an angle $\alpha$ of incidence smaller than 90° so that the alien particles suspended in the gas, striking the side 26, rebound far from the muffler 22 while the gas is sucked in the an inlet 27 formed in an end of the apex of the 24, and from this point conveyed to the cylinder I6.

The side 25 of the groove 24, is of less depth than the side 26, causes the gas to strike said side 26 and at the same time keeps the gas, free from the alien particles, in proximity to the inlet 27 so that, in the suction phase, a big quantity of gas is conveyed to the cylinder 16 and thus the refrigerator efficiency is always high.

The groove 24, being formed in the body of the muffler 22, does not affect the structure, thus no vibrations, no increase of noise and no damages appear which may compromise the operation of the compressor.

I claim:

1. A muffler system for a refrigeration motor-compressor comprising an upper and lower case, a body mounted within said lower case, a compressor mounted on said body, a motor operatively connected to said compressor, a muffler mounted on said compressor, a tube having a longitudinal axis fixed to said lower case for conveying refrigerant gas into said cases and a V-shaped groove having asymmetrical sides positioned transversely to the longitudinal axis of said tube and along the muffler, one side of said groove closest to said tube being of lesser depth than said side further away from said tube, said side of said groove further away from said tube having an angle of incidence with the longitudinal axis of said tube such that alien particles suspended in the refrigerant flow over said side of said groove of lesser depth to strike the side of said groove of greater depth and upon striking the side of the groove of greater depth causing said particles to rebound away from said muffler, and said groove defining means for conveying refrigerant gas to said compressor.

2. The muffler according to claim 1, wherein said means comprise an inlet formed at an end of said groove at the apex thereof.

3. The muffler according to claim 1 wherein said angle of incidence is smaller than 90°.

* * * * *